US012005327B2

(12) United States Patent
Hettinger et al.

(10) Patent No.: US 12,005,327 B2
(45) Date of Patent: Jun. 11, 2024

(54) GOLF CLUB HAVING AN ADJUSTABLE WEIGHT ASSEMBLY

(71) Applicant: Acushnet Company, Fairhaven, MA (US)

(72) Inventors: Ronald K. Hettinger, Oceanside, CA (US); Kevin Tassistro, San Marcos, CA (US); Richard L. Cleghorn, Oceanside, CA (US)

(73) Assignee: ACUSHNET COMPANY, Fairhaven, MA (US)

( * ) Notice: Subject to any disclaimer, the term of this patent is extended or adjusted under 35 U.S.C. 154(b) by 0 days.

(21) Appl. No.: 17/660,147

(22) Filed: Apr. 21, 2022

(65) Prior Publication Data

US 2023/0338794 A1 Oct. 26, 2023

(51) Int. Cl.

*A63B 53/06* (2015.01)
*A63B 53/04* (2015.01)
*A63B 102/32* (2015.01)

(52) U.S. Cl.

CPC .. *A63B 53/0475* (2013.01); *A63B 2053/0479* (2013.01); *A63B 2053/0491* (2013.01); *A63B 2102/32* (2015.10)

(58) Field of Classification Search

CPC ..... A63B 53/047; A63B 2053/0491; A63B 53/0445
USPC ..... 473/324–350
See application file for complete search history.

(56) References Cited

U.S. PATENT DOCUMENTS 5,489,097 A * 2/1996 Simmons ..... A63B 53/0487 D21/736
6,015,354 A * 1/2000 Ahn ..... A63B 53/04 473/341
6,440,006 B1 * 8/2002 Johnson ..... A63B 53/0487 473/340
6,923,734 B2 * 8/2005 Meyer ..... A63B 60/02 473/341
7,927,231 B2 * 4/2011 Sato ..... A63B 53/06 473/336
7,938,739 B2 * 5/2011 Cole ..... A63B 53/04 473/332
8,182,364 B2 * 5/2012 Cole ..... A63B 53/04 473/335
8,376,878 B2 * 2/2013 Bennett ..... A63B 60/02 473/335
8,777,774 B1 * 7/2014 Kim ..... A63B 60/02 473/335

(Continued)

FOREIGN PATENT DOCUMENTS

GB 2316011 A * 2/1998 ..... A63B 53/04
JP 08206259 A * 8/1996 ..... A63B 53/047

*Primary Examiner* — Alvin A Hunter
(74) *Attorney, Agent, or Firm* — LEWIS ROCA ROTHGERBER CHRISTIE LLP

(57) ABSTRACT

An iron-type golf club head includes: a body having an outer surface and including a striking face; a channel extending into the body and having an opening in the outer surface of the body; and a weighted insert shaped and sized to be at least partially inserted into the channel and including a heavy end and a light end, wherein the channel is oriented such that, when the weighted insert is at least partially inserted into the channel, a longitudinal axis of the weighted insert is parallel to a striking face plane that is tangential to an outermost surface of the striking face.

16 Claims, 15 Drawing Sheets

(56) References Cited

U.S. PATENT DOCUMENTS

| | | | | |
|---|---|---|---|---|
| 8,956,243 | B2 * | 2/2015 | Kim | A63B 53/06 473/335 |
| 9,333,390 | B1 * | 5/2016 | Manwaring | A63B 60/02 |
| 9,421,432 | B2 | 8/2016 | Galvan et al. | |
| 2010/0304887 | A1 * | 12/2010 | Bennett | A63B 53/0475 473/335 |
| 2011/0039632 | A1 * | 2/2011 | Bennett | A63B 53/06 473/328 |
| 2011/0152001 | A1 * | 6/2011 | Hirano | A63B 53/0466 473/335 |
| 2017/0232309 | A1 * | 8/2017 | Dolezel | A63B 60/42 473/282 |

* cited by examiner

GOLF CLUB HAVING AN ADJUSTABLE WEIGHT ASSEMBLY

BACKGROUND

The flight characteristics of a golf ball after being struck by a golf club are dependent not only on the swing of the golf club but also on the golf club itself. For example, flight characteristics of the golf ball, such as fades, draws, launch angles, ball spin, and speed are impacted by the design of the golf club. By adjusting one or more design properties of the golf club, the flight characteristics of the golf ball can be improved, thereby increasing golf club performance. In some examples, adjusting a center of gravity (CG) and/or a moment of inertia (MOI) of a head of the golf club through inclusion of a weighted insert in a golf club head impacts the flight characteristics of the golf ball. However, such weighted inserts need to be securely attached to the golf club head. As such, improvements to weight assemblies including weighted inserts for golf club heads are desired.

SUMMARY

In an aspect, the technology relates to an iron-type golf club head, including: a body including: a striking face having a lower leading edge and an upper topline edge, a sole extending from the lower leading edge, and a back portion positioned rearward of the striking face and coupled between the sole and the upper topline edge, wherein one or more of the striking face, the sole, and the back portion define at least part of an outer surface of the body; a channel extending into the body and having an opening in the outer surface of the body; and a weighted insert shaped and sized to be at least partially inserted into the channel and including a heavy end and a light end, wherein the channel is oriented such that, when the weighted insert is at least partially inserted into the channel, a longitudinal axis of the weighted insert is substantially parallel to a striking face plane that is tangential to an outermost surface of the striking face.

In an example, a plurality of grooves is provided in the striking face and extend in a toe-heel direction, and the channel is oriented such that, when the weighted insert is at least partially inserted into the channel, the longitudinal axis of the weighted insert is nonparallel to a longitudinal axis of at least one of the plurality of grooves. In another example, the channel extends at least partially between a toe and a heel of the body and is contained entirely within a wedge-shaped portion of the body protruding from the striking face and defined at least in part by the sole. In another example, the opening of the channel is at a toe of the body, and the channel extends into the body towards a heel of the body. In another example, the golf club head further includes a cap configured to secure the weighted insert inside the channel and configured to be positionable in at least a closed position whereby the cap secures the weighted insert inside the channel, and in an opened position whereby the weighted insert is at least partially insertable into, and removable from, the channel. In an example, the weighted insert is shaped and sized so that the cap compresses the weighted insert along the longitudinal axis of the weighted insert when the cap is in the closed position. In another example, the cap includes a threaded cap configured to be at least partially screwed into the channel when the cap is in the closed position. In another example, the cap is pivotally coupled to the body at a fastener is configured to be pivotable about the fastener between the open position and the closed position when the fastener is in a loosened position.

In another aspect, the technology relates to an iron-type golf club head, including: a body having an outer surface and including a striking face having a lower leading edge and an upper topline edge; a channel extending into the body and having an opening in the outer surface of the body; a weighted insert shaped and sized to be at least partially inserted into the channel and including a heavy end and a light end, wherein the channel is oriented such that, when the weighted insert is at least partially inserted into the channel, a longitudinal axis of the weighted insert is parallel to a striking face plane that is tangential to an outermost surface of the striking face; and a threaded cap configured to be at least partially screwed into the channel to secure the weighted insert inside the channel.

In an example, the threaded cap includes: a first component including a head and a threaded portion extending from the head and configured to be screwed at least partially into the channel to secure the weighted insert inside the channel; and a second component coupled to the first component and having a hole exposing at least part of the head. In another example, the head of the first component is rotatably coupled to the second component by a c-clip. In another example, the opening of the channel is in an indent in the outer surface of the body, the second component is shaped and sized such that, when the threaded cap is at least partially screwed into the channel, an exterior surface of the second component is level with a portion of the outer surface of the body adjacent to the indent, and the exterior surface of the second component is at least double in surface area in comparison to a cross-sectional area of the hole. In another example, a breadth of the hole in the second component is equal to or less than a breadth of a tool indent in the head. In another example, the second component is different in density than the body of the iron-type golf club head.

In another aspect, the technology relates to an iron-type golf club head, including: a body having an outer surface and including a striking face; a channel extending into the body and having an opening in the outer surface of the body; a weighted insert shaped and sized to be at least partially inserted into the channel and including a heavy end and a light end, wherein the channel is oriented such that, when the weighted insert is at least partially inserted into the channel, a longitudinal axis of the weighted insert is parallel to a striking face plane that is tangential to an outermost surface of the striking face; and a cap pivotally attached to the body and configured to be in a closed position whereby the cap secures the weighted insert inside the channel and an opened position whereby the weighted insert is at least partially insertable into, and removable from, the channel.

In an example, the opening of the channel is in an indent in the outer surface of the body, the cap has an interior surface and an exterior surface, and the cap is shaped and sized such that the exterior surface is level with a portion of the outer surface of the body adjacent to the indent when the cap is in the closed position. In another example, the cap has an interior surface and an exterior surface, and the interior surface compresses the weighted insert along the longitudinal axis of the weighted insert when the cap is in the closed position. In another example, the cap includes a main body configured to secure and retain the weighted insert inside the channel when the cap is in the closed position, and a pivot arm extending from the main body onto a back portion of the body positioned rearward to the striking face, and the cap is configured to pivot about a fastener extending through an opening in the pivot arm. In another example, the cap is pivotally attached to the body by a fastener configured to be in at least a tightened position whereby the cap is not moveable between the closed position and the opened position, and a loosened position whereby the cap is moveable between the closed position and the opened position. In an example, the fastener is configured to be tightened into the body to keep the cap from pivoting in order to indirectly secure the weighted insert inside the channel by the cap.

This summary is provided to introduce a selection of concepts in a simplified form that are further described below in the Detailed Description. This summary is not intended to identify key features or essential features of the claimed subject matter, nor is it intended to be used to limit the scope of the claimed subject matter.

BRIEF DESCRIPTION OF THE DRAWINGS

Non-limiting and non-exhaustive examples are described with reference to the following Figures.

DETAILED DESCRIPTION

The technologies described herein contemplate a golf club head, such as an iron-type golf club head or other golf club head, that includes an adjustable weight retention assembly including a weighted insert. Through the weight balance of the golf club head, the flight characteristics of the golf ball can be improved, thereby increasing golf club performance. In the examples described herein, the weight retention assembly enables for the CG and/or MOI of a golf club head to be adjusted by the weighted insert to impact the flight characteristics of the golf ball, such as fades, draws, launch angles, ball spin, and speed. Additionally or alternatively, the weight retention assembly enables for the swing weight of the golf club head to be adjustable (e.g., increasing or decreasing the weight of the club head).

In examples, the present technologies provide a golf club head with a channel defined therein. A weighted insert may be inserted into, or removed from, the channel and secured therein by a cap. A longitudinal axis of the channel and/or a longitudinal axis of the weighted insert when in the channel may be substantially parallel to a striking face of the golf club head in order to control the position of the CG between the toe and heel without affecting the depth of the CG between the striking face and a back portion of the golf club head positioned rearward to the striking face.

Figure 1:
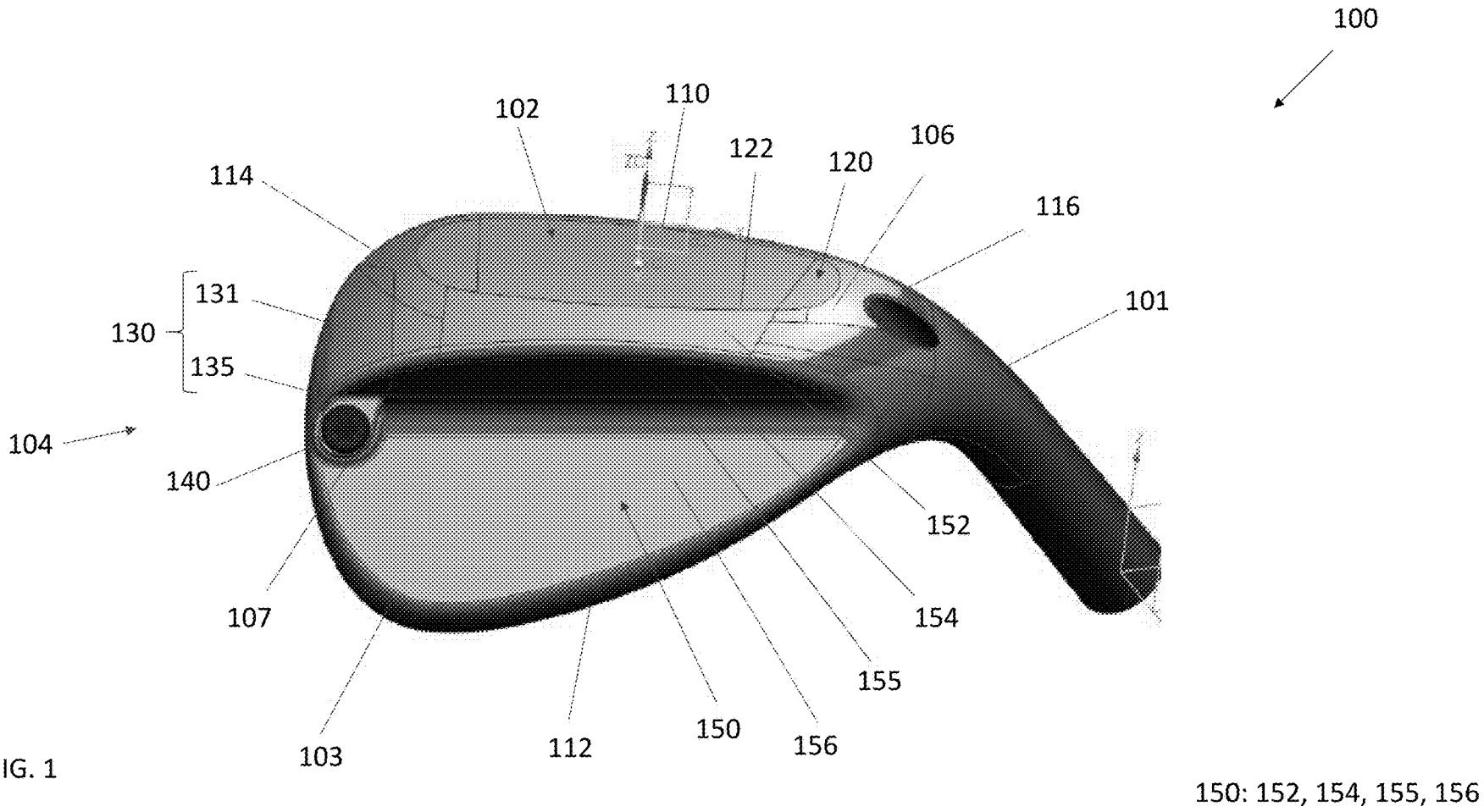
FIG. 1 is an upside down back view of a golf club head with an example weight retention assembly in a closed position.
Figure 2:
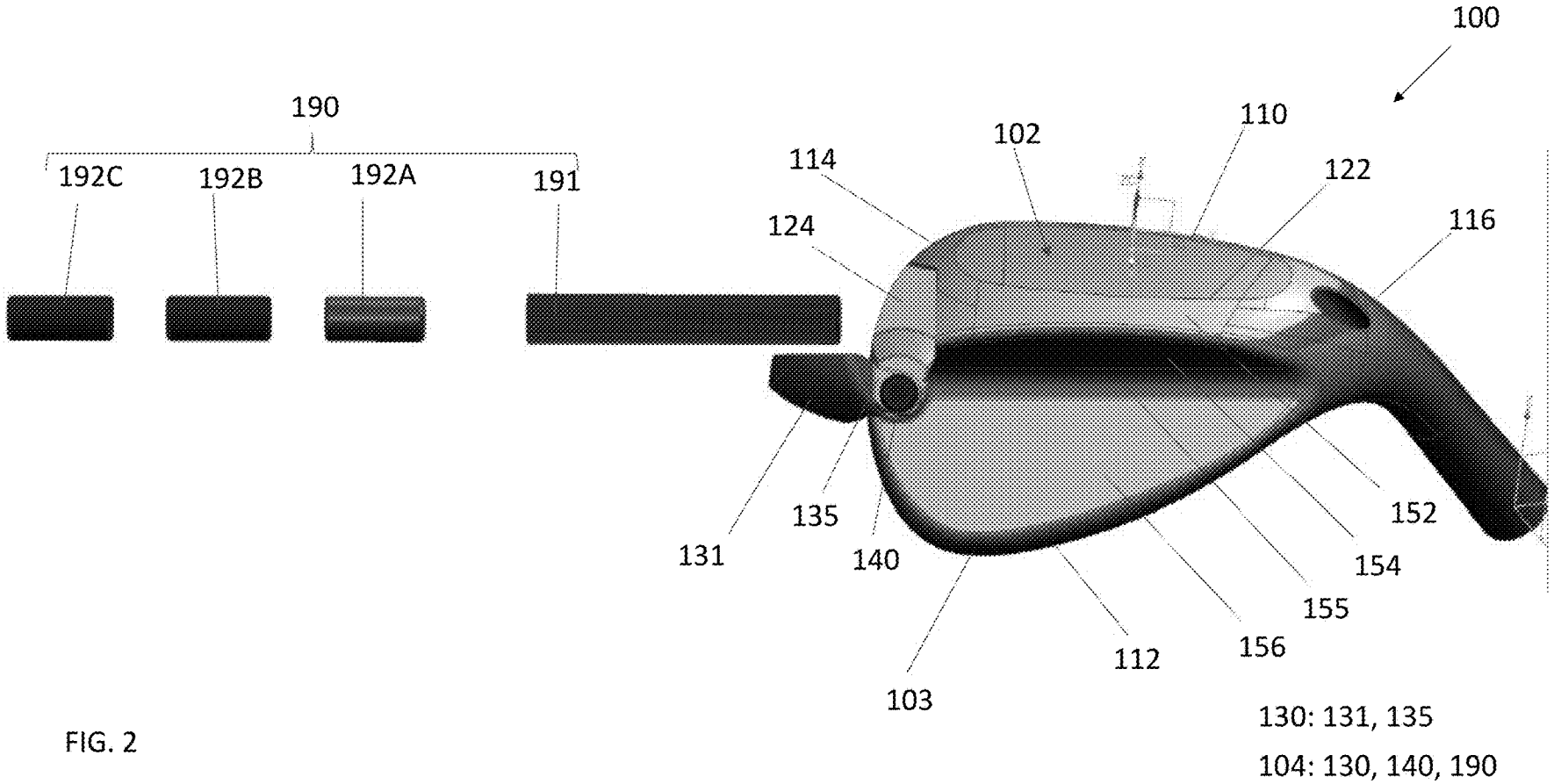
FIG. 2 is another upside down back view of the golf club head of FIG. 1 when the weight retention assembly is in an opened position and an exploded view of an example weighted insert of the weight retention assembly.
Figure 3:
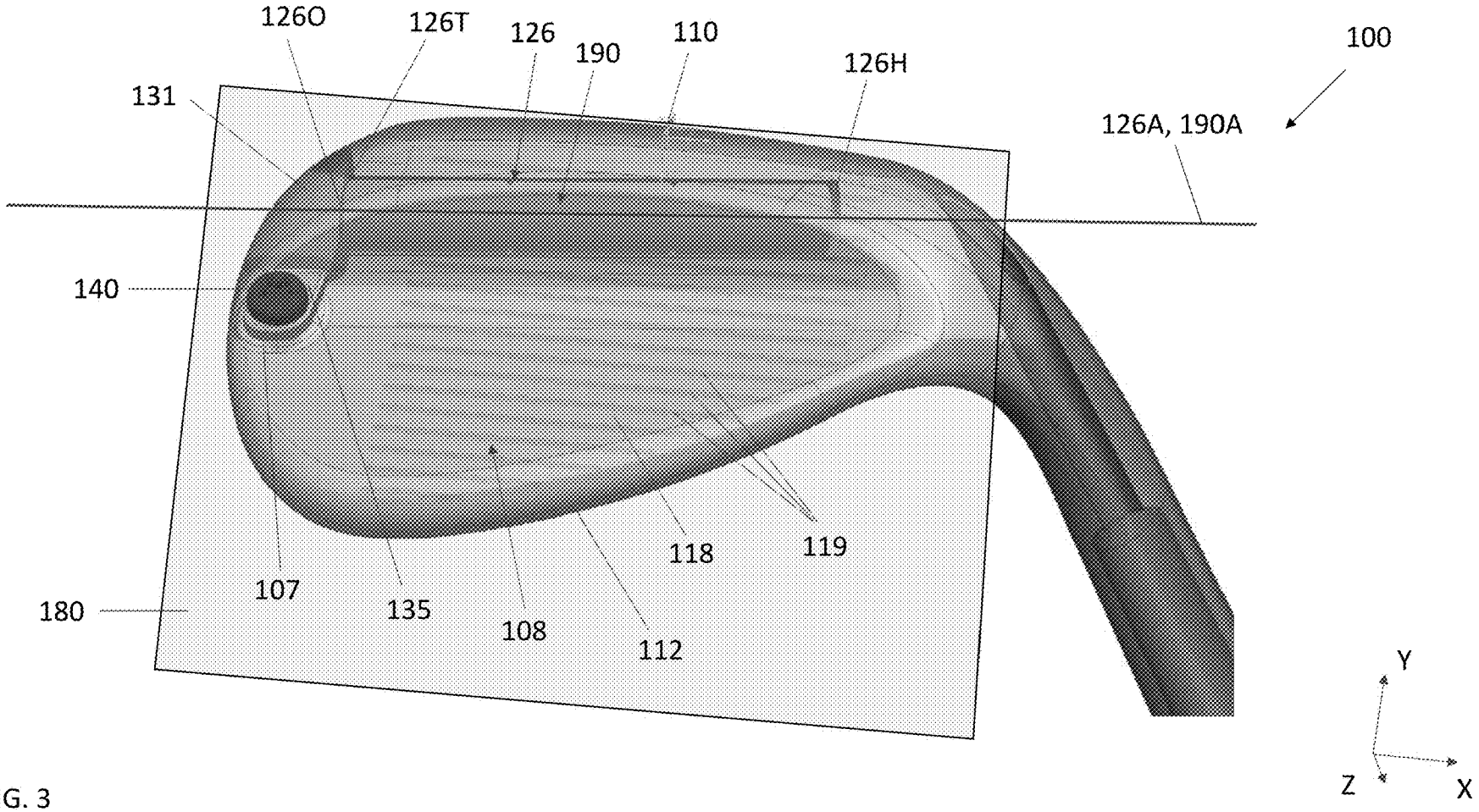
FIG. 3 is another upside down and partially transparent back view of the golf club head of FIG. 1 when the weight retention assembly is in the closed position.
Figure 4:
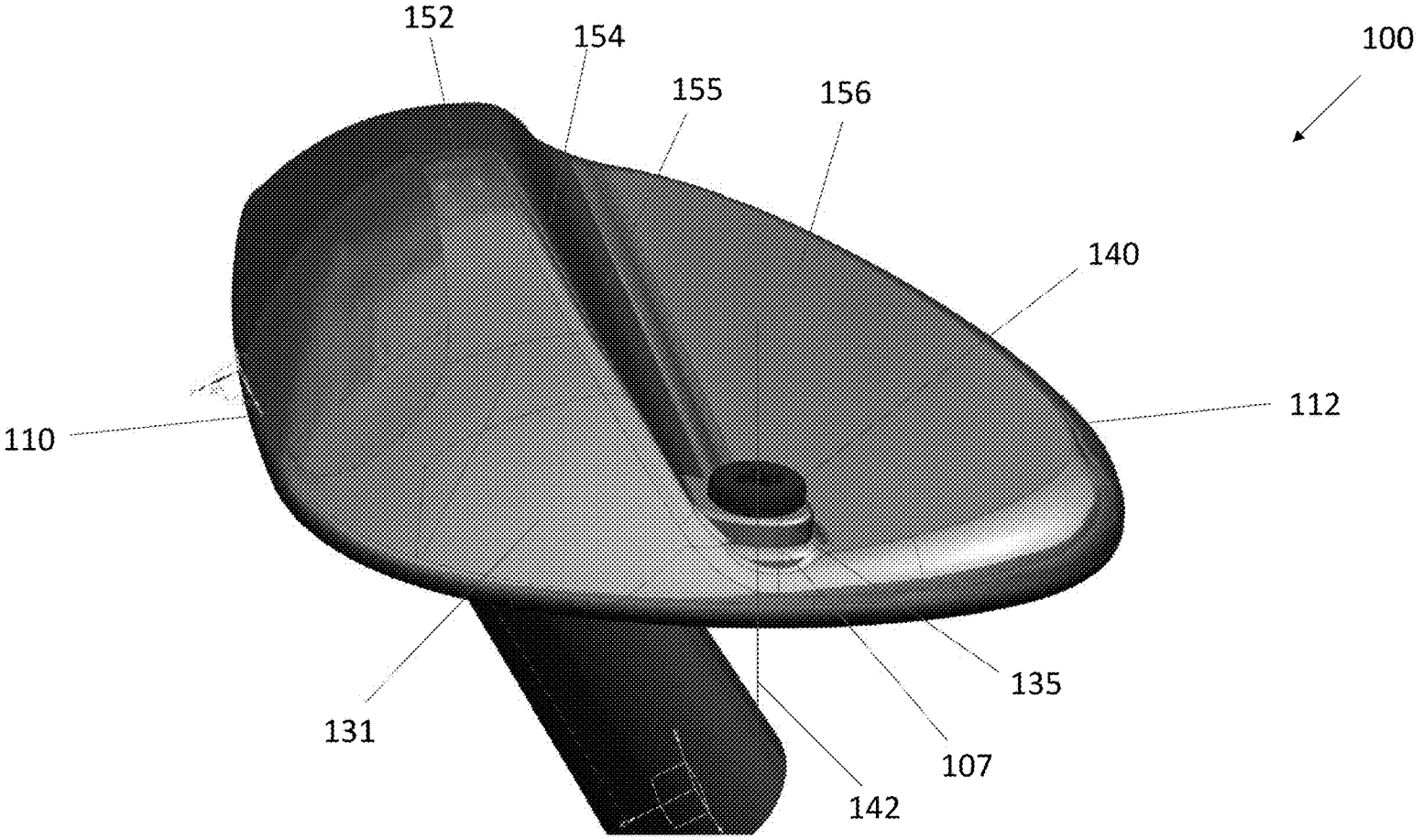
FIG. 4 is a perspective view of the golf club head of FIG. 1 when the weight retention assembly is the closed position.
Figure 5:
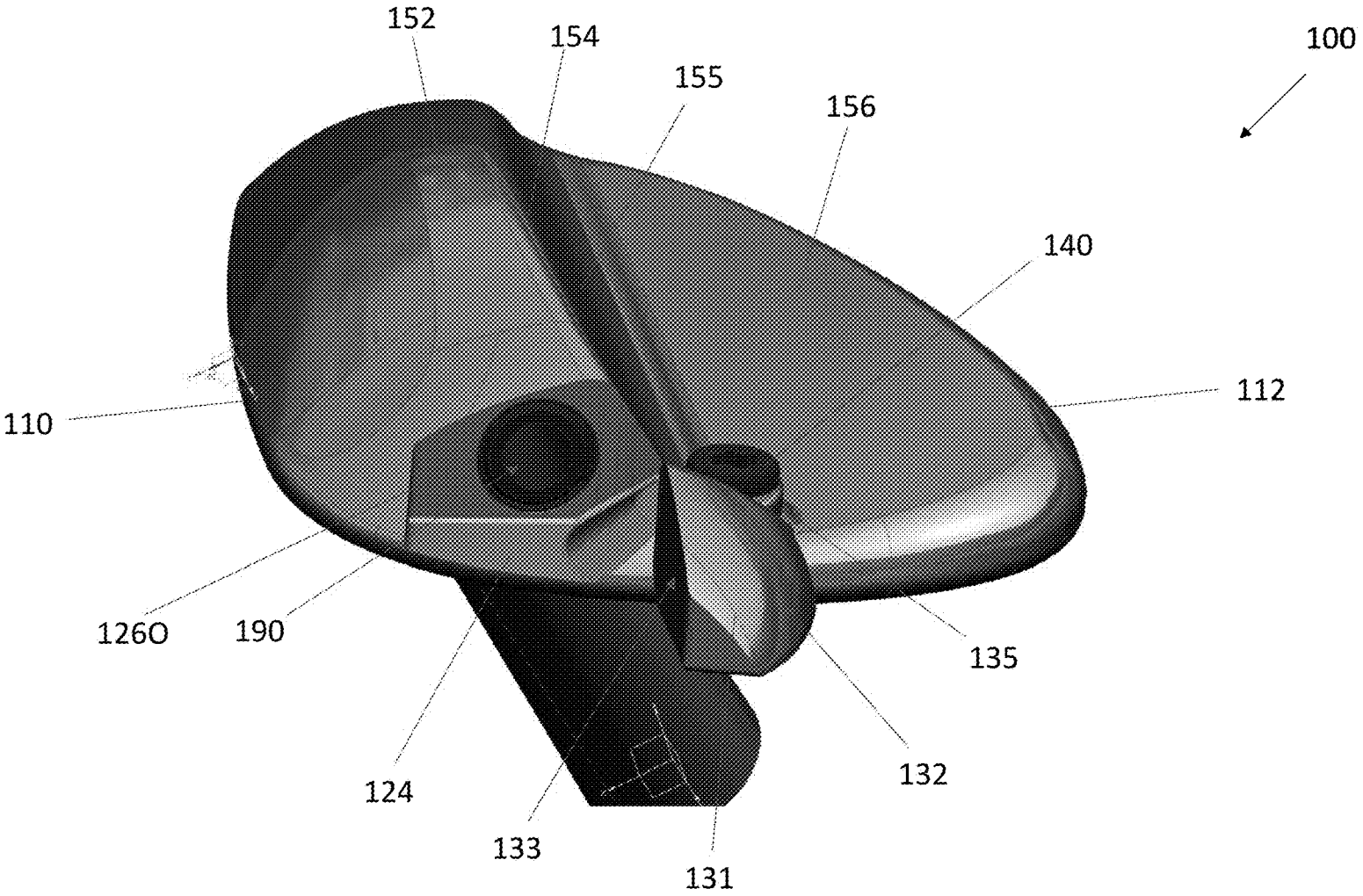
FIG. 5 is another perspective view of the golf club head of FIG. 1 when the weight retention assembly is in the opened position.
Figure 6:
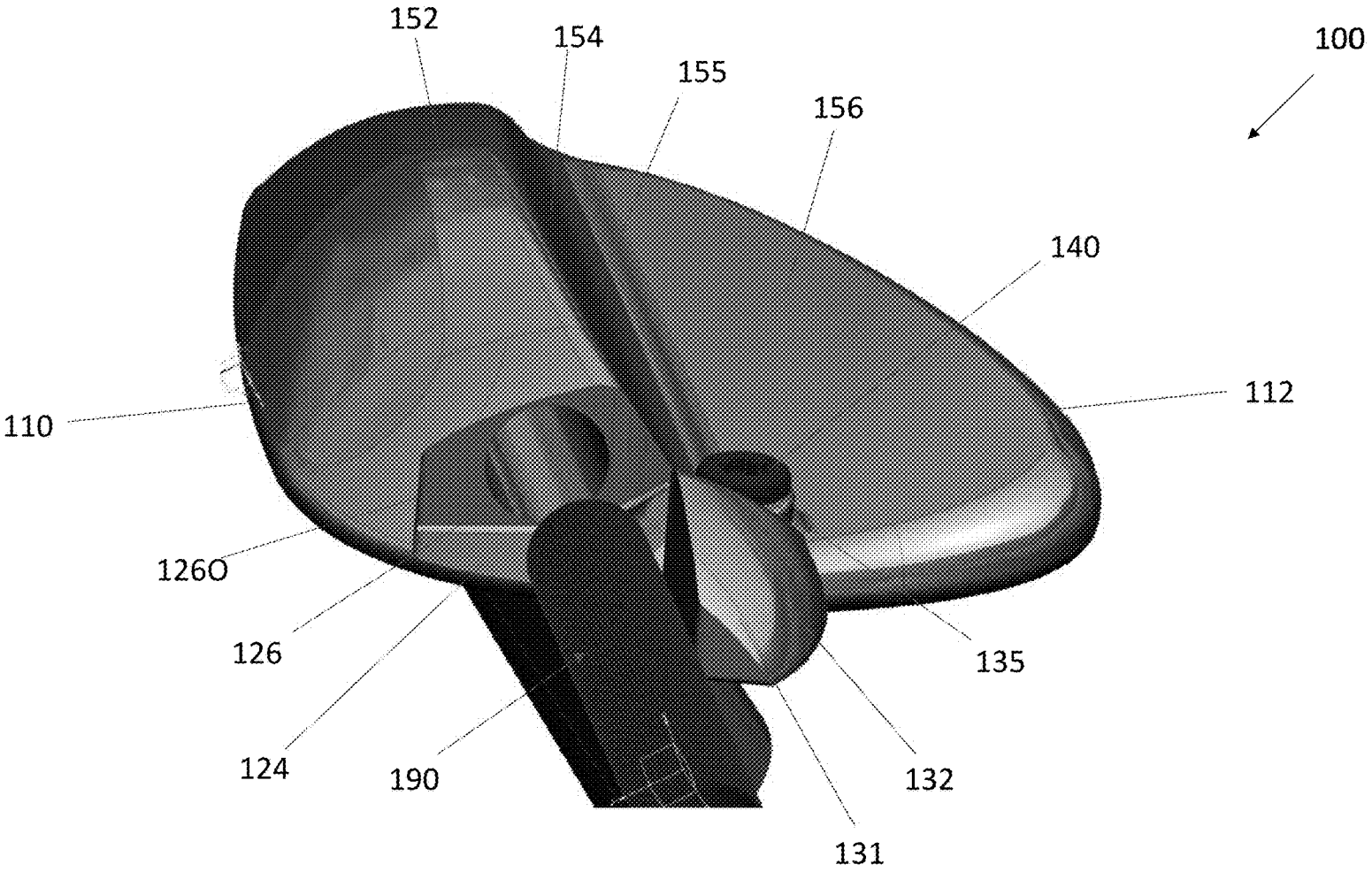
FIG. 6 is another perspective view of the golf club head of FIG. 1 when the weight retention assembly is in the opened position.

FIG. 1 is an upside down back view of a golf club head 100 with an example weight retention assembly 104 in a closed position. In particular, the golf club head 100 is an iron-type golf club head in the depicted example. FIG. 2 is another upside down back view of the golf club head 100 of FIG. 1 when the weight retention assembly 104 is in an opened position and an exploded view of an example weighted insert 190 of the weight retention assembly 104. FIG. 3 is another upside down and partially transparent back view of the golf club head 100 of FIG. 1 when the weight retention assembly 104 is in the closed position. FIG. 4 is a perspective view of the golf club head 100 of FIG. 1 when the weight retention assembly 104 is the closed position. FIG. 5 is another perspective view of the golf club head 100 of FIG. 1 when the weight retention assembly 104 is in the opened position. FIG. 6 is another perspective view of the golf club head 100 of FIG. 1 when the weight retention assembly 104 is in the opened position.

Referring concurrently to FIGS. 1-6, the golf club head 100 is an iron-type golf club head. The iron-type golf club head may be, for example, a wedge-type golf club head. The golf club head 100 may include a body 106 having a striking face 108 with a lower leading edge 110 and an opposite upper topline edge 112 extending between a toe 114 and a heel 116. The striking face 108 (shown in transparent view of FIG. 3 through the back portion 150 of golf club head 100) may have an outermost surface 118 and multiple grooves 119 formed in the outermost surface 118 to help impart spin on a golf ball when struck by the striking face 108. For example, the striking face 108 may be defined similarly as striking face 308 in FIG. 11. The outermost surface 118 may be substantially flat except for the grooves 119. The body 106 may have a sole 102 extending from the lower leading edge 110 on the bottom side of the golf club head 100 to a rearward portion 122 of the sole 102. The rearward portion 122 may be defined as an edge or corner on the body 106. A back portion 150 may be coupled between the rearward portion 122 of the sole 102 and the upper topline edge 112. A top portion 103 may be coupled between the upper topline edge 112 and the back portion 150, and the top portion 103 may be a thin surface extending between the toe 114 and the heel 116. In some examples, the top portion 103 is not present, and the upper topline edge 112 may be directly connected to the back portion 150. The back portion 150 may comprise all surfaces of an outer surface 120 of the body 106 of the golf club head 100 that are both between the rearward portion 122 of the sole 102 and the top portion 103 and also between the toe 114 and the heel 116. The striking face 108, the sole 102, the back portion 150, and the top portion 103 may be coupled together so as to define at least part of the outer surface 120 of the body 106. A hosel 101 may be disposed at the heel 116 and is configured to couple to a shaft (not shown).

The back portion 150 may include a lower back surface 152 coupled between the rearward portion 122 of the sole 102 and the top portion 103, a first back surface 154 coupled between the lower back surface 152 and the top portion 103, an intermediate back surface 155 coupled between the first back surface 154 and the top portion 103, and a second back surface 156 coupled between the intermediate back surface 155 and the top portion 103.

The lower back surface 152 may be substantially flat or may be substantially flat except for a curve along the toe 114—heel 116 direction. In some examples, the lower back surface 152 extends from the rearward portion 122 in a direction substantially parallel to the striking face 108. In some examples, the lower back surface 152 may be excluded, and the first back surface 154 may extend from the rearward portion 122 of the sole 102.

The first back surface 154 may be substantially flat and may extend from an edge of the lower back surface 152 distal to the rearward portion 122 in a direction toward the intermediate back surface 155 such that at least part of a virtual extension of the first back surface 154 intersects the striking face 108. In some examples, the first back surface 154 may extend towards (e.g., may extend along a direction to be closer to) the upper topline edge 112 of the golf club head 100.

The intermediate back surface 155 may be a curved or substantially flat surface extending from an edge of the first back surface 154 distal to the lower back surface 152 to the second back surface 156. In some examples, the intermediate back surface 155 may be excluded, and the second back surface 156 extends from the first back surface 154.

The second back surface 156 may be substantially flat and parallel to the striking face 108. The second back surface 156 may extend from an edge of the intermediate back surface 155 distal to the first back surface 154 to the top portion 103. The first and second surfaces 154 and 156 may generally form an obtuse angle. For example, an obtuse angle may be formed where virtual extensions of the first and second surfaces 154 and 156 meet.

The back portion 150 may include any one or more of the lower back surface 152, the first back surface 154, the intermediate back surface 155, and the second back surface 156, and may include one or more additional surfaces.

A channel 126 is defined in the body 106. The channel 126 may extend along a toe 114—heel 116 direction and have a toe end 126T and a heel end 126H. The channel 126 may extend into the body 106 from an opening 126O in the outer surface 120 of the body 106 at the toe end 126T. In some examples, the channel 126 extends into the body 106 from an opening in the body 106 at the heel end 126H. In some other examples, the channel 126 extends in the body 106 between openings in the body 106 at each of the toe end 126T and the heel end 126H. The channel 126 may be defined entirely within the sole 102 or at least partially in a portion of the body 106 adjacent to, or corresponding to, the sole 102. For example, the channel 126 may be defined at least partially in a wedge shaped portion of the body 106 protruding from the striking face 108 and being at least partially defined by the sole 102, the lower back surface 152, and the first back surface 154.

The weight retention assembly 104 may include a weighted insert 190, a cap 130, and a fastener 140. The weighted insert 190 may be shaped and sized to be at least partially insertable into the channel 126. The cap 130 may be configured to be coupled to the body 106 at the opening 126O and may be shaped and sized to at least partially cover the opening 126O in a closed configuration of the weight retention assembly 104. The fastener 140 may be configured to couple the cap 130 to the body 106 and to indirectly retain and secure the weighted insert 190 at least partially inside the channel 126 by the cap 130 in the closed position of the weight retention assembly 104. The weight retention assembly 104 may be configured to be positionable in at least the closed position whereby the weighted insert 190 is retained and secured inside the channel 126 and an opened position whereby the weighted insert 190 is insertable into, and removable from, the channel 126.

The weighted insert 190 may include a sheath 191 and a plurality of weights 192A, 192B, and 192C. The weights 192A, 192B, and 192C may be at least partially contained (e.g., sealed) within the sheath 191, and the sheath 191 may include a soft material, such as foam or a polymer, to provide a protective buffer between the plurality of weights 192A, 192B, and 192C and the walls of the channel 126. In other examples, the weighted insert 190 may comprise a single, unitary piece with a lighter end and a heavier end. The sheath 191 may be shaped and sized to be at least partially positionable in the channel 126 and to be oriented within the channel 126 in at least two different orientations. For example, the sheath 191 may be oriented in the channel 126 in a first orientation wherein a first end of the sheath 191 along the length of the sheath 191 is at the toe end 126T of the channel 126, and in a second orientation wherein the first end of the sheath 191 is at the heel end 126H of the channel 126. The sheath 191 may have a cavity extending along a lengthwise direction of the sheath 191 and shaped and sized to contain (e.g., seal) the weights 192A, 192B, and 192C inside the cavity of the sheath 191 in any suitable order along the length of the cavity of the sheath 191. In some examples, the sheath 191 is not included, and the weights 192A, 192B, and 192C are shaped and sized to be insertable into the channel 126 in any suitable order along the length of the channel 126 between the toe and heel ends 126T and 126H of the channel 126.

In some examples, the weights 192A, 192B, and 192C include a first weight 192A, a second weight 192B, and a third weight 192C. One of the first, second, and third weights 192A, 192B, and 192C may be different in density from one or both of the remaining two weights of the first, second, and third weights 192A, 192B, and 192C. For example, the first weight 192A may be denser than each of the second and third weights 192B and 192C. In some examples, the first weight 192A may include a metal, and the second and third weights 192B and 192C may include a compressible polymer, foam, etc. The first, second, and third weights 192A, 192B, and 192C may be sequentially positioned in the channel 126, for example, based on the arrangement of the weights 192A, 192B, and 192C in the cavity of the sheath 191 and the orientation of the sheath 191 inside the channel 126, in any order to control the MOI and the position of the CG of the golf club head 100. For example, the first weight 192A having a greater density than each of the second and third weights 192B and 192C may be arranged at a heavy end of the weighted insert 190 that may be selectively positioned adjacent to the toe end 126T or the heel end 126H to respectively move the position of the CG of the golf club head 100 closer to the toe 114 or the heel 116. This control over the position of the CG of the golf club head 100 along the toe-heel direction allows a golfer to at least partially correct a fade or draw bias in his or her swing.

In some examples, the plurality of weights may include any suitable number of weights, such as two weights, four weights, five weights, or more than five weights. In some other examples, a single weight having a nonuniform weight distribution along a length of the weight may be utilized in the weighted insert 190 instead of the plurality of weights. For example, the weight may include a heavy end and a light end, wherein the heavy end includes a denser material than the light end. For example, the heavy end may include a metal, and the light end may include a compressible lightweight material, such as a foam or polymer. The weight may be shaped and sized to be positioned in the channel 126 and oriented within the channel 126 with the heavy end at either the toe end 126T or at the heel end 126H. Accordingly, the position of the CG of the golf club head 100 along the toe-heel direction may be controllable by controlling the orientation of the weight in the channel 126.

One or both of a longitudinal axis 126A of the channel 126 and a longitudinal axis 190A of the weighted insert 190 when positioned inside of the channel 126 may be substantially parallel to a striking face plane 180 tangential to the outermost surface 118 of the striking face 108. For example, the striking face plane 180 may be defined similarly to striking face plane 380 in FIG. 11. By orienting one or both of the longitudinal axes 126A and 190A to be substantially parallel to the striking face plane 180, a position of the CG of the golf club head 100 along the toe-heel direction can be controlled without affecting the depth position of the CG between the striking face 108 and the back portion 150 of the golf club head 100.

In some examples, the longitudinal axis 126A of the channel 126 extends through a center (e.g., geometric center) of the channel 126 and along a lengthwise direction of the channel 126 between the toe end 126T and the heel end 126H of the channel 126. The longitudinal axis 126A may be parallel to a wall of the channel 126 extending between the toe end 126T and the heel end 126H of the channel 126. In some examples, when the weighted insert 190 is at least partially positioned inside the channel 126 and the weight retention assembly 104 is in the closed position, the longitudinal axis 190A of the weighted insert 190 extends through a center of the weighted insert 190 and along a lengthwise direction of the weighted insert 190. The longitudinal axis 190A of the weighted insert 190 may extend through a collective center of the plurality of weights 192A, 192B, and 192C (or through a center of a single weight in examples where the single weight is utilized instead of the plurality of weights), and may extend along a collective lengthwise direction of the plurality of weights 192A, 192B, and 192C (or along a lengthwise direction of the single weight). In some examples, the longitudinal axis 190A may be parallel to a sidewall of one or more of the plurality of weights 192A, 192B, and 192C (or along a sidewall of the single weight). In some examples, the longitudinal axis 190A coincides with the longitudinal axis 126A.

As used herein, reference to the longitudinal axes 126A and 190A being substantially parallel to the striking face plane 180 includes examples where the longitudinal axes 126A and 190A are exactly parallel to the striking face plane 180 and examples where the longitudinal axes 126A and 190A deviate from being exactly parallel to the striking face plane 180 by a certain amount. In some examples, substantially parallel is defined to include zero degrees, or between zero degrees and one degree, or between zero degrees and two degrees, or between zero degrees and five degrees, or between zero degrees and ten degrees of deviation of the longitudinal axes 126A and 190A from being exactly parallel to the striking face plane 180.

One or both of the longitudinal axes 126A and 190A may be substantially parallel to a longitudinal axis of one of the plurality of grooves 119, for example, any one of the three grooves 119 closest to the lower leading edge 110. The longitudinal axis of the groove 119 may extend along a direction parallel to the X-axis, as depicted in FIG. 3. In some examples, a coordinate system is defined as being centered at the CG of the golf club head 100, having an x-axis parallel to the longitudinal axis of one of the plurality of grooves 119, having a y-axis perpendicular to the x-axis and parallel to the striking face plane 180, and a z-axis perpendicular to both the x-axis and the y-axis. In some examples, the X-axis, Y-axis, and Z-axis, as depicted in FIG. 3, are respectively parallel to the x-axis, y-axis, and z-axis, as described above. The longitudinal axis of the groove 119 and the longitudinal axes 126A and 190A may therefore be parallel to the X-axis, as depicted. By orienting one or both of the longitudinal axes 126A and 190A to be substantially parallel to the longitudinal axis of the groove 119, the position of the CG between the toe 114 and heel 116 of the golf club head 100 can be controlled without affecting a height position of the CG of the golf club head 100 (e.g., a position of the CG along the Y-axis, as depicted in FIG. 3) or the depth position of the CG of the golf club head 100 (e.g., a position of the CG along the Z-axis).

In some other examples, such as in FIG. 3, one or both of the longitudinal axes 126A and 190A are substantially parallel to the striking face plane 180 without being parallel to the longitudinal axis of the groove 119. For example, in a plan view defined by the striking face plane 180, one or both of the longitudinal axes 126A and 190A may form a non-zero angle with the longitudinal axis of the groove 119 or with the X-axis, as depicted.

The cap 130 may be a pivotable cap having a main body 131 and a pivot arm 135 coupled to (e.g., extending from) the main body 131, and the cap 130 may be configured to pivot relative to the body 106 at the pivot arm 135 and about the fastener 140.

The main body 131 may have an exterior surface 132 and an interior surface 133, and may be shaped and sized to correspond to (e.g., to fill or to be received in) an indent 124 in the outer surface 120 of the body 106 when the weight retention assembly 104 is in the closed position. The indent 124 may be positioned such that the opening 126O of the channel 126 is at least partially in the indent 124. The exterior surface 132 may be visible from outside the golf club head 100 when the weight retention assembly 104 is in the closed position, and the interior surface 133 may be substantially not visible from the outside of the golf club head 100 when the weight retention assembly 104 is in the closed position. However, the interior surface 133 may be at least partially visible from the outside of the golf club head 100 when the weight retention assembly 104 is in the opened position. The interior surface 133 may include a substantially planar surface that faces the opening 126O. In some examples, the interior surface 133 at least partially compresses the weighted insert 190 (e.g., compresses sheath 191) into the channel 126 when the weight retention assembly 104 is moved from the opened position to the closed position. When the weight retention assembly 104 is moved from the closed position to the opened position, the weighted insert 190 (e.g., the sheath 191 and/or at least one of the plurality of weights 192A, 192B, and 192C) may expand to at least partially extend through the opening 126O of the channel 126. Ease of removal of the weighted insert 190 may be improved when the weighted insert 190 is shaped and sized to at least partially extend through the opening 126O in the opened position. For example, the weighted insert 190 may be easier to grasp and pull out of the channel 126 when it at least partially extends through the opening 126O. The exterior surface 132 may be level with a region of the outer surface 120 of the golf club head 100 adjacent to the exterior surface 132 when the weight retention assembly 104 is in the closed position. For example, the exterior surface 132 may be continuous and smooth with the region of the outer surface 120 adjacent to the exterior surface 132 when the weight retention assembly 104 is in the closed position.

In some examples, the main body 131 includes (e.g., is defined as) a portion of the body 106 that is not integral with the remainder of the body 106, but which is moveable relative to the remainder of the body 106. In some examples, the main body 131 is fabricated by forming the body 106 and then cutting out the main body 131 from the remainder of the body 106. In some other examples, the body 106 and the main body 131 are separately fabricated, and the main body 131 is shaped and sized to correspond to (e.g., to fill or be received into) the indent 124 of the body 106. In some examples, the main body 131 is shaped and sized to continue contours of the body 106 that would otherwise be present but for the addition of the weight retention assembly 104 to golf club head 100. That is, the main body 131 continues the contours of the sole 102 and toe 114 when the weight retention assembly 104 is in the closed position.

The fastener 140 may be selectively positionable along a fastener axis 140A and may be configured to extend both through an opening in the pivot arm 135 and at least partially into the body 106. The opening (e.g., hole) in the pivot arm 135 may be shaped and sized to receive at least a portion of the fastener axis 140A, and the body 106 of the golf club head 100 may have a hole shaped and sized to receive at least a portion of the fastener 140. The opening in the pivot arm 135 and the hole in the body 106 may be aligned with each other when the fastener 140 extends through the opening in the pivot arm 135 and at least partially into the body 106. The body 106 may have a protrusion 107 at the hole of the body 106 that slightly protrudes from an adjacent region of the body 106. In some examples, the protrusion 107 is a mound or stepped surface that at least partially surrounds the hole of the body 106.

The fastener 140 may be positionable in at least a loosened position whereby the cap 130 is pivotable around the portion of the fastener 140 extending through the opening in the pivot arm 135, and a tightened position whereby the cap 130 is substantially unable (e.g., substantially restrained) to pivot. Accordingly, the weight retention assembly 104 may be moveable between the opened and closed positions when the fastener 140 is in the loosened position, and the position (e.g., closed position or opened position) of the weight retention assembly 104 may be fixed when the fastener 140 is in the tightened position. In some examples, the fastener 140 extends at least partially into the body 106 in the closed position, and the fastener 140 is at least partially (e.g., entirely) moved out from the body 106 when moved from the closed position to the opened position. The fastener 140 may extend farther into the body 106 in the closed position than in the opened position.

In some examples, the fastener 140 is a threaded screw-type fastener having a threaded pole extending from a head that is larger in breadth (e.g., diameter) than the threaded pole. The pivot arm 135 may be at least partially positioned (e.g., sandwiched) between the body 106 and the head of the screw-type fastener. In the tightened position, the pivot arm 135 may be compressed between the body 106 and the head of the screw-type fastener such that rotational movement of the cap 130 about the threaded pole is resisted. The threaded pole of the screw-type fastener may be partially moved out of the body 106 when moved from the tightened position to the loosened position such that the pivot arm 135 is not compressed between the body 106 and the head of the screw-type fastener and such that the cap 130 becomes freely rotatable about the threaded pole of the screw-type.

The fastener 140 may extend at least partially into the body 106 through the back portion 150, such as through a toe side of the second back surface 156. The fastener axis 140A may be oriented to intersect the striking face 108 and to be substantially perpendicular to the striking face plane 180. In some examples, the fastener axis 140A may additionally or alternatively be perpendicular to the second back surface 156, for example, a virtual plan tangential to a region of the second back surface 156.

Figure 7:
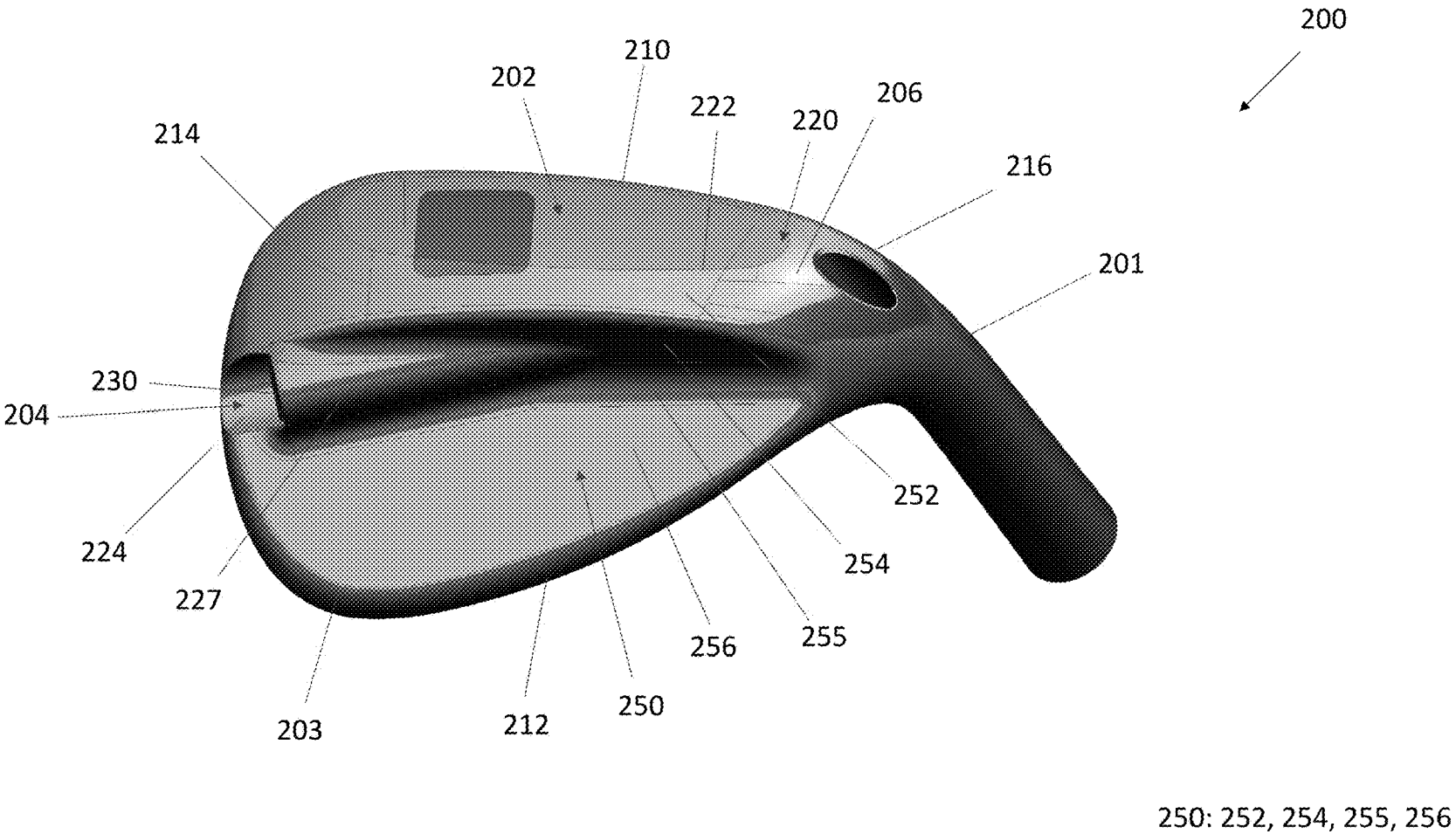
FIG. 7 is an upside down back view of a golf club head with another example weight retention assembly in a closed position.
Figure 8:
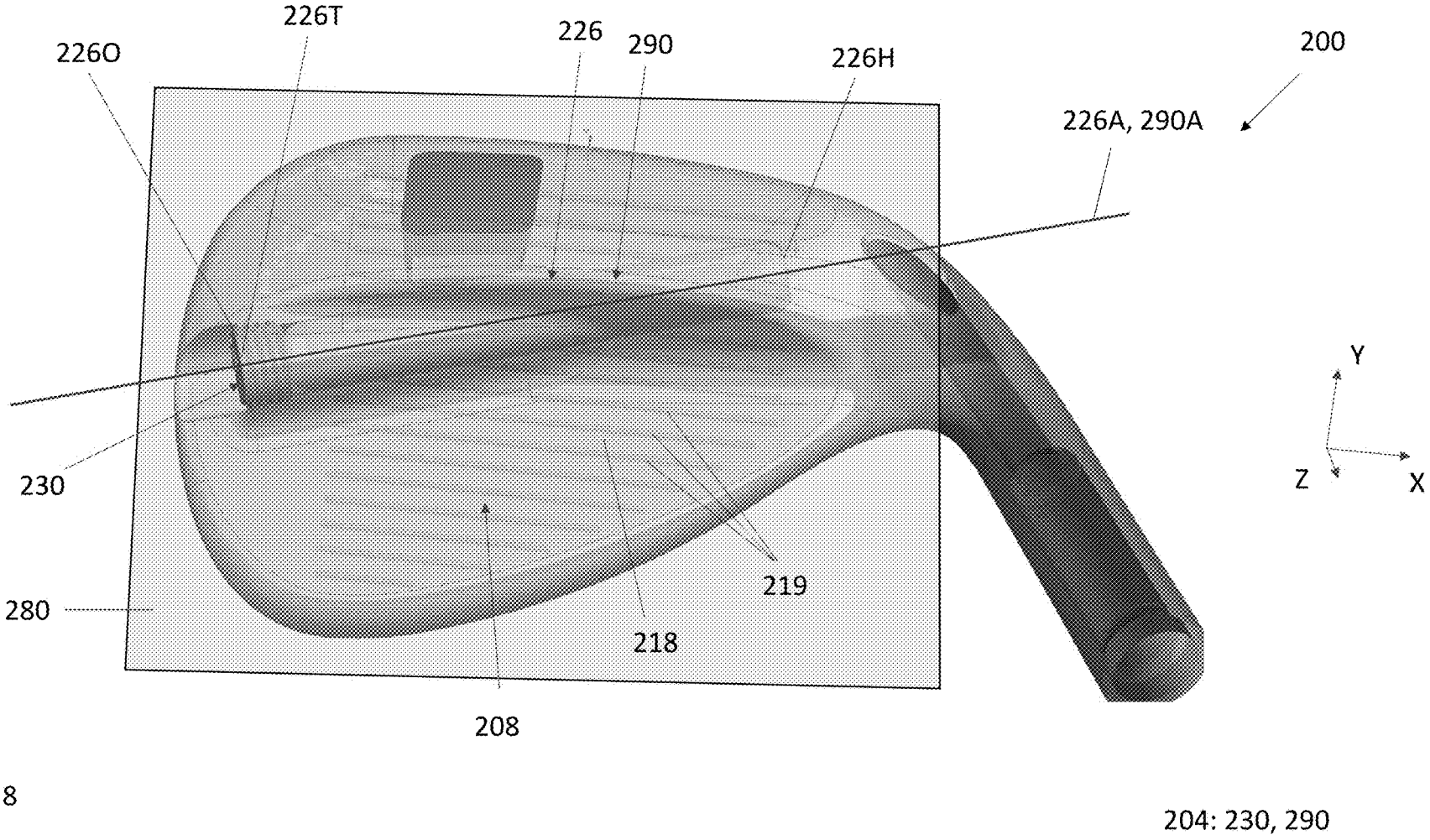
FIG. 8 is another upside down and partially transparent back view of the golf club head of FIG. 7 when the weight retention assembly is in the closed position.
Figure 9:
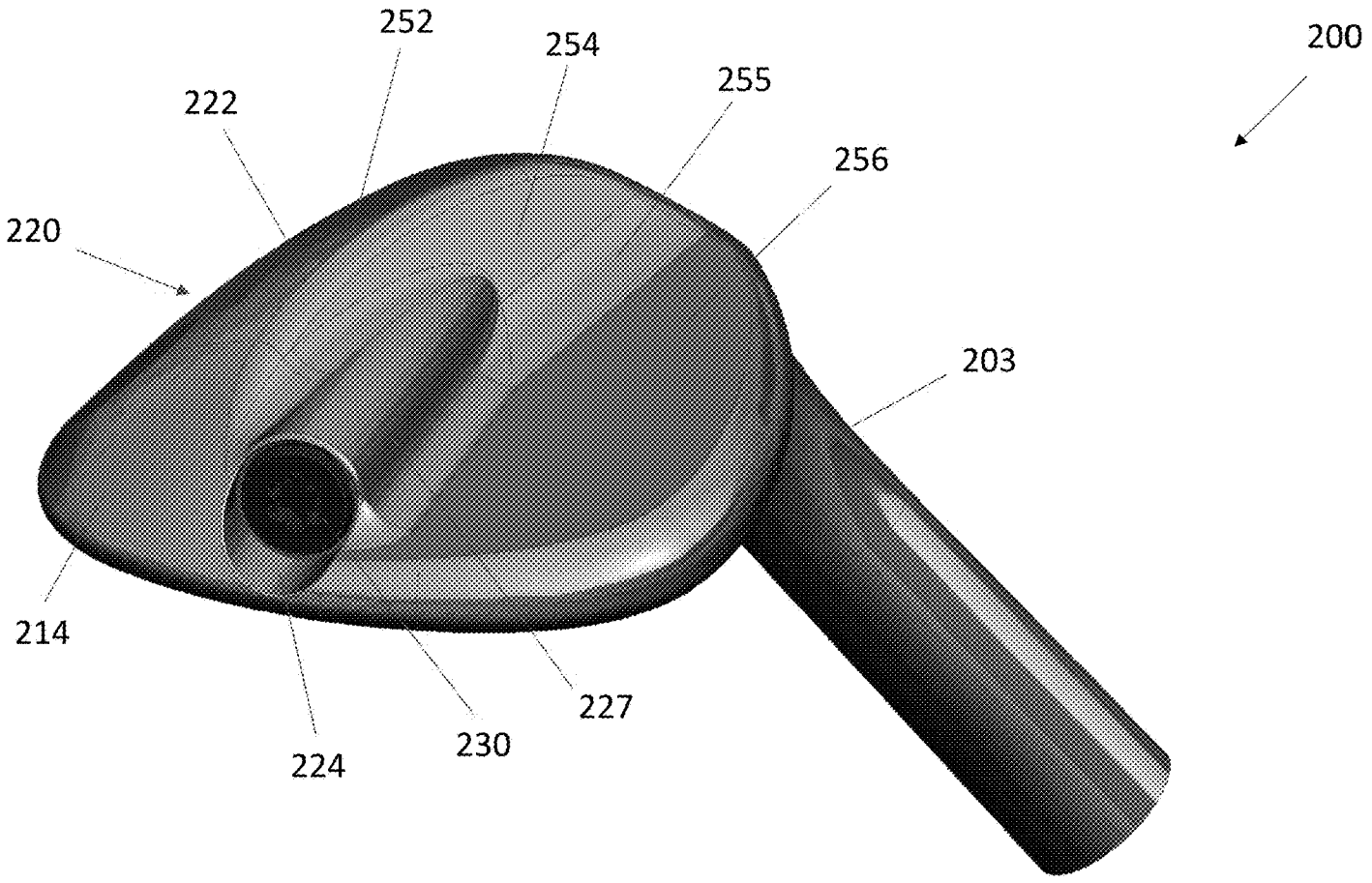
FIG. 9 is a perspective view of the golf club head of FIG. 7 when the weight retention assembly is in the closed position.

FIG. 7 is an upside down back view of a golf club head 200 with another example weight retention assembly 204 in a closed position. In this example, the golf club head 200 is an iron-type golf club head. FIG. 8 is another upside down and partially transparent back view of the golf club head 200 of FIG. 7 when the weight retention assembly 204 is in the closed position. FIG. 9 is a perspective view of the golf club head 200 of FIG. 7 when the weight retention assembly 204 is in the closed position. The golf club head 200 of the embodiment illustrated in FIGS. 7-9 may include some features similar to, or the same as, features illustrated and described above with respect to the golf club head 100 of FIGS. 1-6, and redundant descriptions may not be repeated.

Referring concurrently to FIGS. 7-9, the golf club head 200 may have a body 206 including a toe 214, a heel 216, a top portion 203, a striking face 208 (e.g., as shown in transparent view in FIG. 8), a sole 202, and a back portion 250. A hosel 201 may be disposed at the heel 216 and be configured to couple to a shaft (not shown). The striking face 208 may have an upper topline edge 212 and an opposite lower leading edge 210. As shown in FIG. 8, the striking face 208 may also have an outermost surface 218 and grooves 219 extending along the toe 214—heel 216 direction. A striking face plane 280 may be tangential to the outermost surface 218 of the striking face 208. The sole 202 extends from the lower leading edge 210 and has a rearward portion 222 distal to the lower leading edge 210. The back portion 250 may be coupled between the rearward portion 222 of the sole 202 and the top portion 203 and may include all surfaces of an outer surface 220 of the body 206 of the golf club head 200 that are both between the rearward portion 222 of the sole 202 and the top portion 203 and also between the toe 214 and the heel 216. In the depicted example, the back portion 250 includes a lower back surface 252, a first back surface 254, an intermediate back surface 255, and a second back surface 256.

A channel 226 is defined in the body 206. The channel 226 may extend along a toe-heel direction and have a toe end 226T and a heel end 226H. The channel 226 may extend into the body 206 from an opening 226O in the outer surface 220 of the body 206 at the toe end 226T. In the depicted example, the channel 226 is defined to be partially in a wedge-shaped portion of the body 206 protruding from the striking face 208 and being at least partially defined by the sole 202, the lower back surface 252, and the first back surface 254. An extension portion 227 of the channel 226 extends out from the wedge-shaped portion of the body 206 along a part of the second back surface 256. In some other examples, the channel 226 may be defined entirely in the wedge-shaped portion of the body 206.

The weight retention assembly 204 includes a weighted insert 290 and a cap 230. The weighted insert 290 may be similar or the same as the weighted insert 190 and may include any features of a weighted insert as described herein.

The cap 230 is a threaded cap configured to be screwed at least partially into the channel 226. The weight retention assembly 204 may be configured to be positionable in at least a closed position whereby the weighted insert 290 is retained and secured insider the channel 226 and an opened position whereby the weighted insert 290 is removable from and insertable into the channel 226. The closed position may correspond to when the cap 230 is at least partially screwed into the channel 226, and the opened position may correspond to when the cap 230 is entirely removed from the channel 226. In some examples, the cap 230 may be coupled to the body 206, for example, by a strip of material, to reduce the risk that the cap 230 may be lost when entirely removed from the channel 226.

The golf club head 200 has an indent 224 in the outer surface 220 adjacent to the opening 226O of the channel 226 to provide room for the cap 230 to be unscrewed out of the channel 226. In some examples, a shape of the indent 204 corresponds to a shape of at least part of the channel 226.

One or both of a longitudinal axis 226A of the channel 226 and a longitudinal axis 290A of the weighted insert 290 positioned inside of the channel 226 may be substantially parallel to the striking face plane 280 so that a position of the CG along a toe-heel direction of the golf club head 200 can be controlled by the weighted insert 290 without affecting the depth position of the CG between the striking face 208 and the back portion 250 of the golf club head 200. In the depicted example, the longitudinal axes 226A and 290A are not parallel to a longitudinal axis of the grooves 219. However, in some other examples, one or both of the longitudinal axes 226A and 290A are substantially parallel to a longitudinal axis of a groove from among the plurality of grooves 219.

Figure 10:
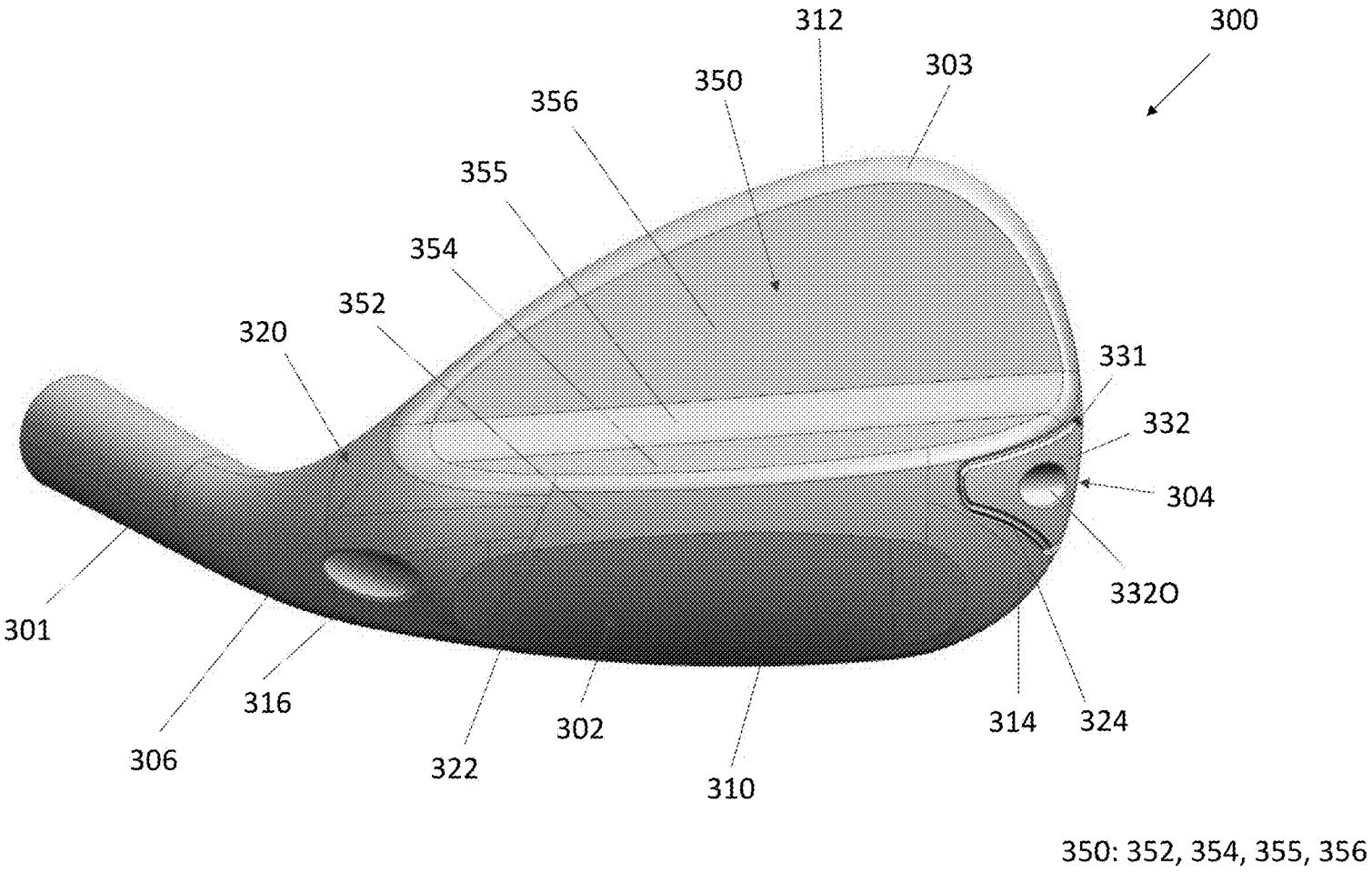
FIG. 10 is a back view of a golf club head with another example weight retention assembly in a closed position.
Figure 11:
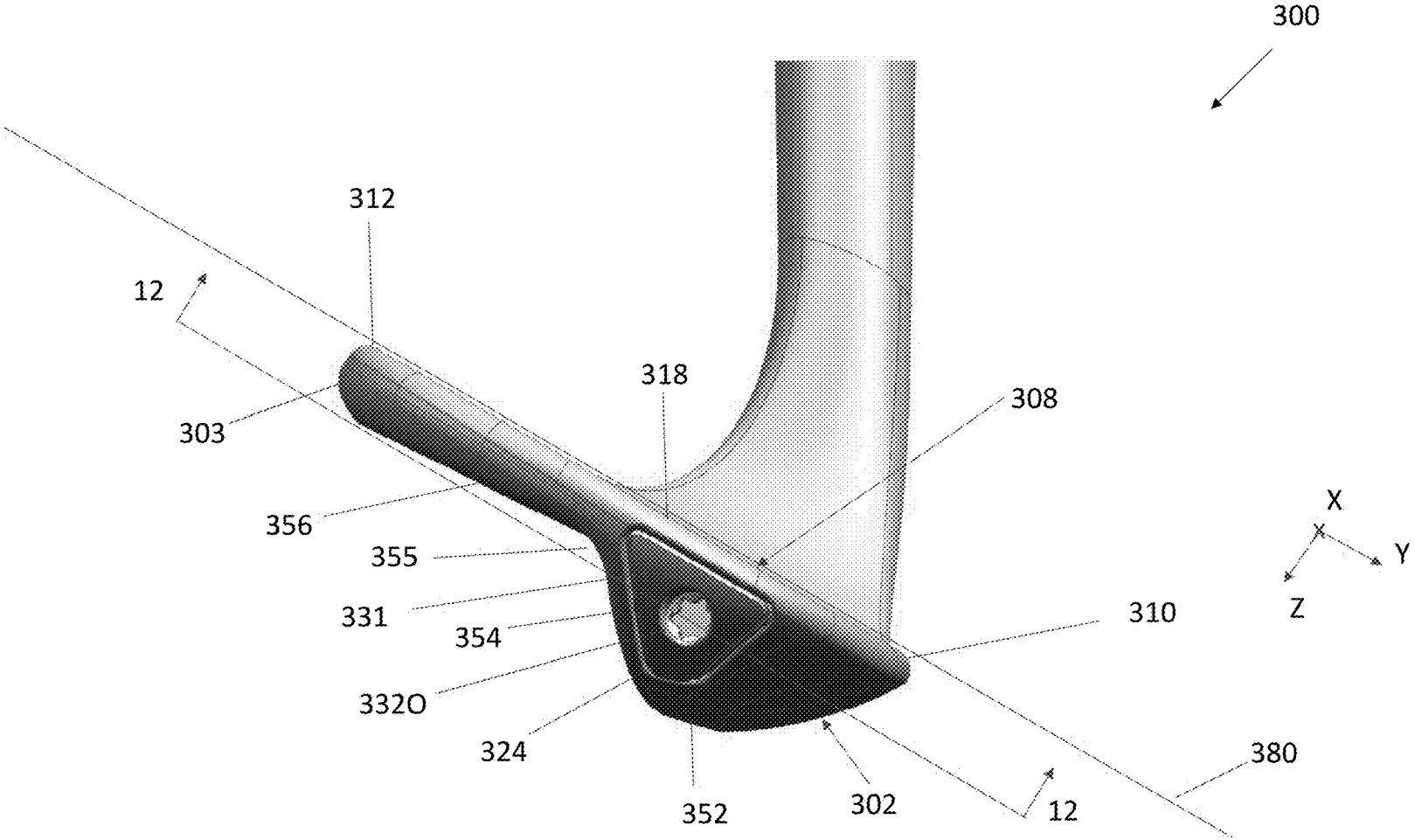
FIG. 11 is a toe-to-heel side view of the golf club head of FIG. 10 when the weight retention assembly is in the closed position.
Figure 12:
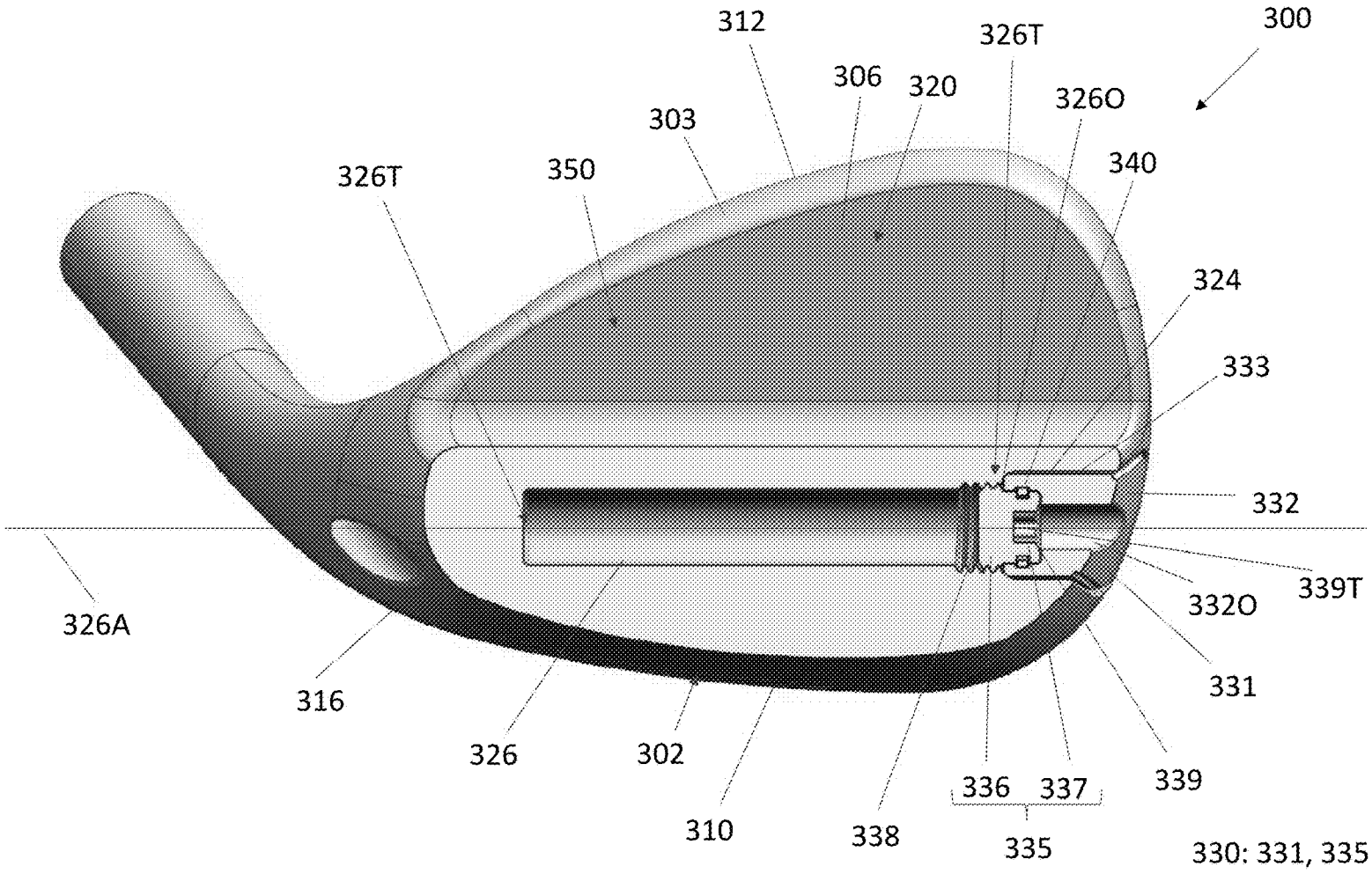
FIG. 12 is a cross-sectional view of the golf club head of FIG. 10 along line 12-12 of FIG. 11 when the weight retention assembly is in the closed position.
Figure 13:
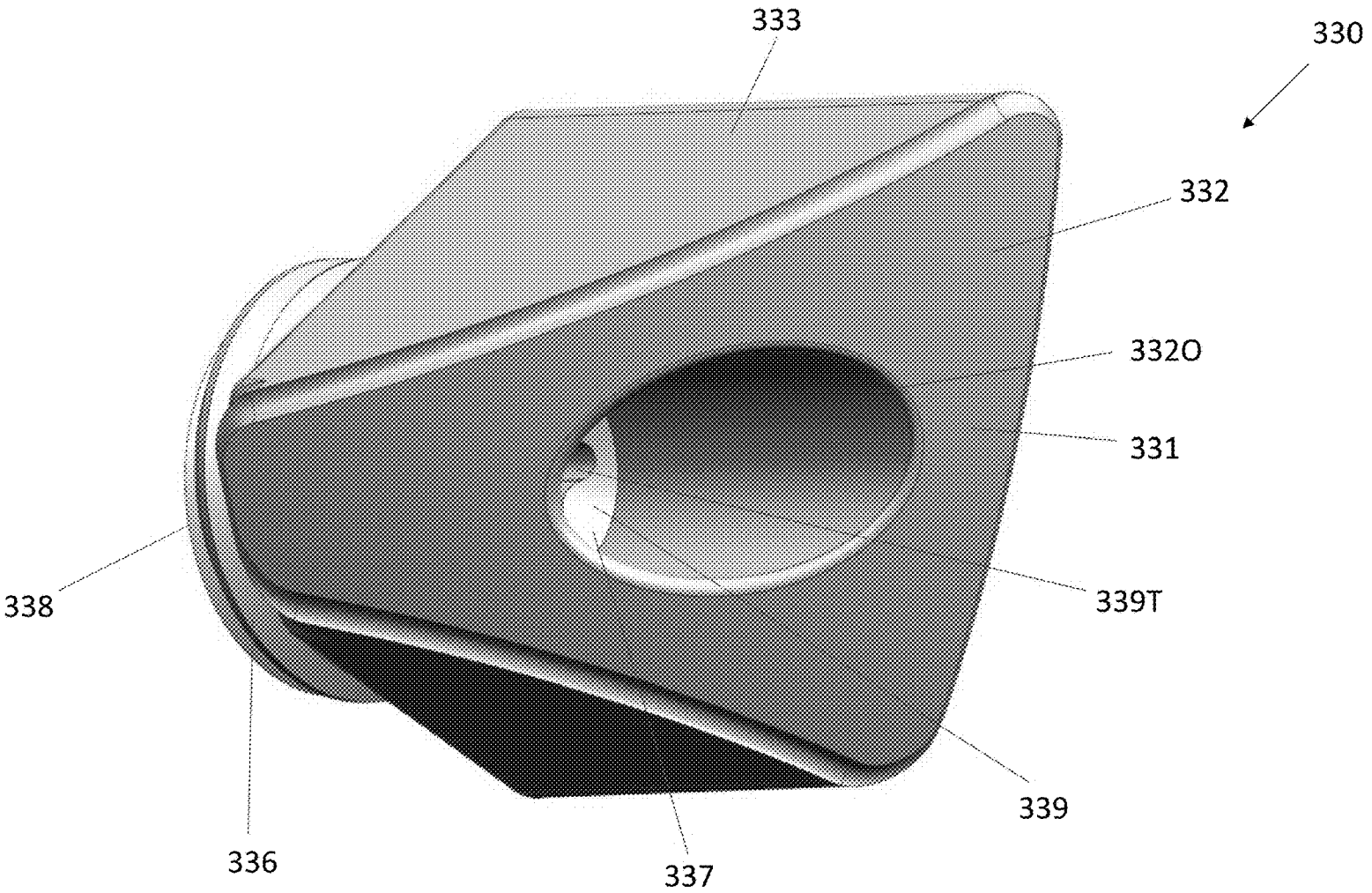
FIG. 13 is a perspective view of a cap of the weight retention assembly of the golf club head of FIG. 10.
Figure 14:
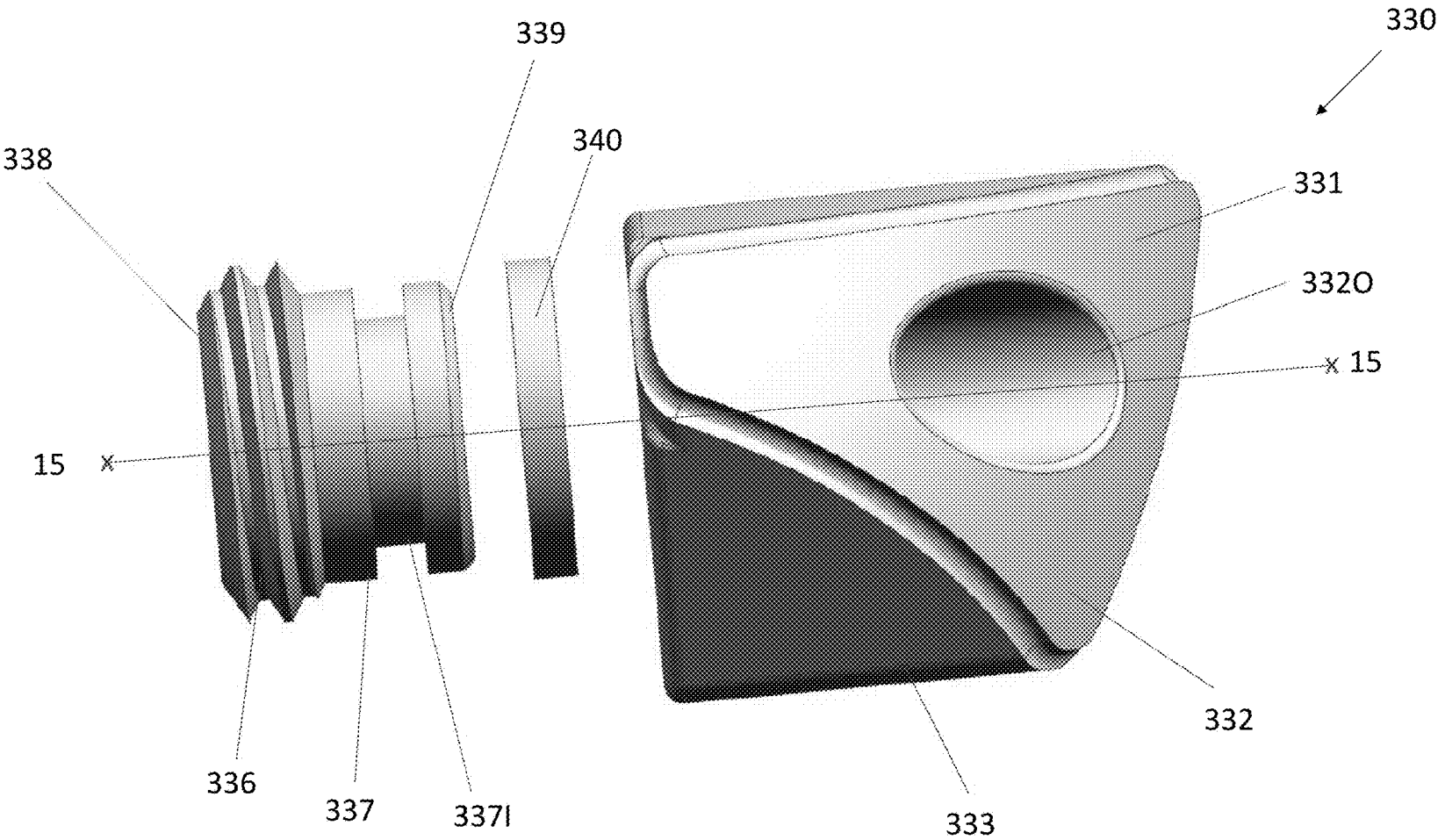
FIG. 14 is an exploded view of the cap of the weight retention assembly of the golf club head of FIG. 10.
Figure 15:
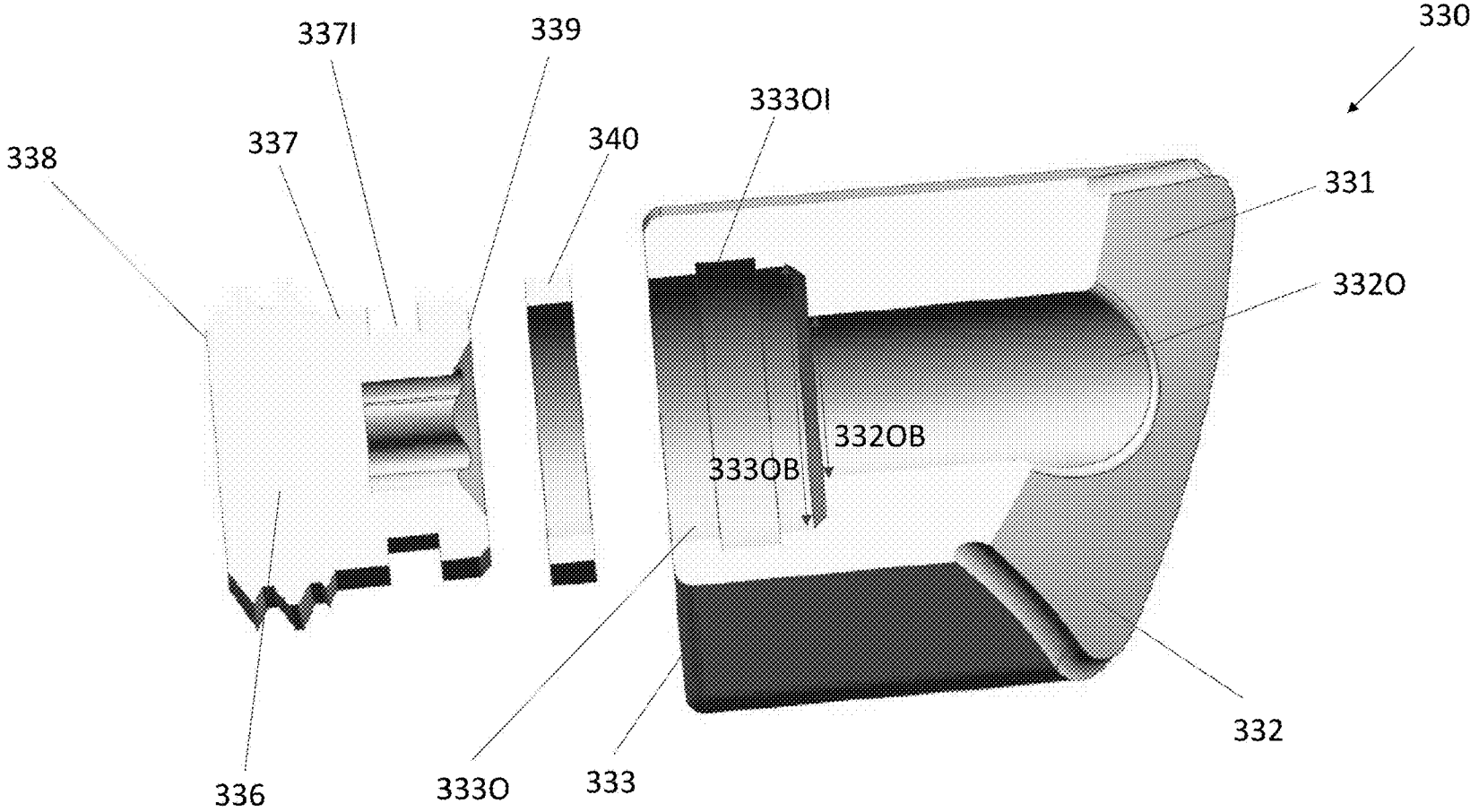
FIG. 15 is a cross-sectional exploded view of the cap of the weight retention assembly of the golf club head of FIG. 10.

FIG. 10 is a back view of a golf club head 300 with another example weight retention assembly 304 in a closed position. In this example, the golf club head 300 is an iron-type golf club head. FIG. 11 is a toe-to-heel side view of the golf club head 300 of FIG. 10 when the weight retention assembly 304 is in the closed position. FIG. 12 is a cross-sectional view of the golf club head 300 of FIG. 10 along line 12-12 of FIG. 11 when the weight retention assembly 304 is in the closed position. FIG. 13 is a perspective view of a cap 330 of the weight retention assembly 304 of the golf club head 300 of FIG. 10. FIG. 14 is an exploded view of the cap 330 of the weight retention assembly 304 of the golf club head 300 of FIG. 10. FIG. 15 is a cross-sectional exploded view of the cap 330 of the weight retention assembly 304 of the golf club head 300 of FIG. 10. The golf club head 300 of the embodiment illustrated in FIGS. 10-15 may include some features similar to, or the same as, features illustrated and described above with respect to the golf club head 100 of FIGS. 1-6 and the golf club head 200 of FIGS. 7-9, and redundant descriptions may not be repeated.

Referring concurrently to FIGS. 10-15, the golf club head 300 may have a body 306 including a toe 314, a heel 316, a top portion 303, a striking face 308, a sole 302, and a back portion 350. A hosel 301 may be disposed at the heel 316 and be configured to couple to a shaft (not shown). The striking face 308 may have an upper topline edge 312 and an opposite lower leading edge 310. As shown in FIG. 11, the striking face 308 may also have an outermost surface 318 and grooves extending along the toe-heel direction. A striking face plane 380 may be tangential to the outermost surface 318 of the striking face 308. The sole 302 extends from the lower leading edge 310 and has a rearward portion 322 distal to the lower leading edge 310.

The back portion 350 may be coupled between the rearward portion 322 of the sole 302 and the top portion 303 and may include all surfaces of an outer surface 320 of the body 306 of the golf club head 300 that are both between the rearward portion 322 of the sole 302 and the top portion 303 and also between the toe 314 and the heel 316. In the depicted example, the back portion 350 includes a lower back surface 352, a first back surface 354, an intermediate back surface 355, and a second back surface 356.

A channel 326 is defined in the body 306. The channel 326 may extend along a toe-heel direction and have a toe end 326T and a heel end 326H. The channel 326 may extend into the body 306 from an opening 326O in the outer surface 320 of the body 306 at the toe end 326T. The channel 326 may be defined to be at least partially in a wedge-shaped portion of the body 306 protruding from the striking face 308 and being at least partially defined by the sole 302, the lower back surface 352, and the first back surface 354.

The weight retention assembly 304 includes a weighted insert (not separately depicted) and a cap 330. The weighted insert may be similar to or the same as the weighted insert 190 described with reference to FIGS. 1-6, and the weighted insert of the weight retention assembly 304 may include any features of a weighted insert as described herein. One or both of a longitudinal axis 326A of the channel 326 and a longitudinal axis of the weighted insert when positioned inside of the channel 326 may be substantially parallel to the striking face plane 380 so that a position of the CG along a toe-heel direction of the golf club head 300 can be controlled by the weighted insert 390 without affecting the depth position of the CG between the striking face 308 and the back portion 350 of the golf club head 300. In some examples, one or both of the longitudinal axis 326A of the channel 326 and the longitudinal axis of the weighted insert may be parallel or nonparallel to a longitudinal axis of one of the grooves in the striking face 308.

The cap 330 is a threaded cap configured to be screwed at least partially into the channel 326. The weight retention assembly 304 may be configured to be positionable in at least a closed position whereby the weighted insert is retained and secured insider the channel 326 and an opened position whereby the weighted insert is removable from and insertable into the channel 326. The cap 330 is at least partially screwed into the channel 326 when the weight retention assembly 304 is in the closed position, and the cap 330 is removed from the channel 326 when the weight retention assembly 304 is in the opened position. In some embodiments, the cap 330 may be coupled to the body 306, for example, by a strip of material, to prevent a golfer from losing the cap 330 when it is removed from the channel 326.

The cap 330 includes a first component 335 and a second component 331. The first component 335 may include a head 337 and a threaded portion 336 extending from the head 337 and configured to be screwed at least partially into the channel 326 to secure the weighted insert inside the channel 326 when the weight retention assembly 304 is in the closed position. For example, the first component 335 may be a screw-type fastener. The threaded portion 336 may include an inner end surface 338 configured to face the channel 326 when the threaded portion 336 is at least partially screwed into the channel 326, and the head 337 may have an outer end surface 339 configured to at least partially face the second component 331 and to face away from the channel 326 when the threaded portion 336 is at least partially screwed into the channel 326. The outer end surface 339 may include a tool indent 339T (e.g., a torx indent) configured to receive a portion of a screw driver or other tool. A breadth of the tool indent 339T may be smaller than one or more of a breadth of the head 337, a breadth of the threaded portion 336, and a breadth of the channel 326. In some examples, the breadth of the tool indent 339T is defined as a maximum breadth of the tool indent 339T or as the diameter of a smallest circle circumscribing the tool indent 339T, and the breadth of the channel 326 is defined as a maximum breadth of the channel 326 along a direction perpendicular to the longitudinal axis 326A of the channel 326.

The second component 331 may be coupled to the first component 335 at the head 337 of the first component 335 and by, for example, a c-clip 340 configured to allow the first component 335 to rotate relative to the second component 331. The head 337 may have a ring-shaped indent 337I shaped and sized to allow the c-clip 340 to be coupled to the head 337.

The second component 331 may have an exterior surface 332 and an interior surface 333, may be shaped and sized to correspond to (e.g., to fill or to be received in) an indent 324 (e.g., hole) in the outer surface 320 of the body 306 when the weight retention assembly 304 is in the closed position. In some examples, the second component 331 is shaped and sized to continue contours of the body 306 that would otherwise be present but for the addition of the weight retention assembly 304 to golf club 300. That is, the second component 331 continues the contours of the sole 302 and toe 314 when the second component 332 is installed, but for a second opening 332O in the second component. The opening 326O of the channel 326 may be at least partially in the indent 324 of the body 306. The exterior surface 332 may be visible from outside the golf club head 300 when the weight retention assembly 304 is in the closed position, and the interior surface 333 may be substantially not visible from the outside of the golf club head 300 when the weight retention assembly 304 is in the closed position. However, the interior surface 333 may be at least partially visible from outside of the golf club head 300 when the weight retention assembly 304 is in the opened position. The exterior surface 332 may be level (e.g., continuous and smooth) with a region of the outer surface 320 of the golf club head 100 adjacent to the exterior surface 332 when the weight retention assembly 304 is in the closed position.

The second component 331 may have a first opening 333O extending at least partially through the second component 331 from the interior surface 333 toward the exterior surface 332 and shaped and sized to receive at least part of the head 337 of the first component 335. The first opening 333O may have a ring-shaped indent 333O1 in a wall of the first opening 333O shaped and sized to allow the c-clip 340 to be coupled to the second component 331. The second component 331 may have the second opening 332O extending at least partially through the second component 331 from the exterior surface 332 toward the interior surface 333 such that at least a portion of the tool indent 339T of the head 337 is exposed by the second opening 332O when the weight retention assembly 304 is in the closed position. In some examples, the first and second openings 333O and 332O are connected together to form an opening extending entirely through the second component 331 from the exterior surface 332 to the interior surface 333. A breadth 332OB of the second opening 332O may be smaller than the breadth of the head 337 and than a breadth 333OB of the first opening 333O, and may be equal to or less than a breadth of the tool indent 339T in the outer end surface 339 of the head 337. In some examples, each of the breadth 333OB of the first opening 333O and the breadth 332OB of the second opening 332O may be defined where the first and second openings 333O and 332O are connected to each other. In some examples, each of the breadth 333OB of the first opening 333O and the breadth 332OB of the second opening 332O may be defined along a direction perpendicular to a longitudinal axis of the first opening 333O, the second opening 332O, or an opening extending entirely through the second component 331 (e.g., an opening defined at least in part by both of the first and second openings 333O and 332O).

The second opening 332O in the second component 331 may be sized to be broad enough to allow for a tool (e.g., screw driver) to be inserted through the second opening 332O to the tool indent 339T so that the first component 335 can be tightened or loosened in the channel 326. In some examples, the exterior surface 332 may be at least two times larger (e.g., at least three times larger, at least four times larger, or at least five times larger) in surface area compared to a cross-sectional area of the second opening 332O at the exterior surface 332. Accordingly, because the second component 331 may be shaped and sized to fill the indent 324 and have the exterior surface 332 level with the adjacent region of the outer surface 320, and because the second opening 332O in the second component 331 may have a smaller size, the cap 330 may substantially visibly hide the channel 326, the indent 324, and the parts of the cap 330 under the exterior surface 332 when the weight retention assembly 304 is in the closed configuration. The outer surface 320 of the golf club head 300, together with the exterior surface 332 of the second component 331, may therefore appear smooth, complete, and uninterrupted when the weight retention assembly 304 is in the closed configuration, except for the opening second 332O.

In some examples, the second component 331 and may include a same material as the body 306. In some other examples, the material of the second component 331 is different from the material of the body 306 and may be heavier or lighter than the material of the body 306 in order to purposely affect the swing weight of the golf club head 300. For example, the second component 331 may include a polymer.

Although specific embodiments and aspects were described herein and specific examples were provided, the scope of the technology is not limited to those specific embodiments and examples. Further, each of the above examples may be combined with another and/or one or more features of some examples may be combined with other examples. One skilled in the art will recognize other embodiments or improvements that are within the scope and spirit of the present technology. Therefore, the specific structure, acts, or media are disclosed only as illustrative embodiments. The scope of the technology is defined by the following claims and any equivalents therein.

What is claimed is:

1. An iron-type golf club head, comprising:

a body comprising:

a striking face having a lower leading edge and an upper topline edge, a sole extending from the lower leading edge, and a back portion positioned rearward of the striking face and coupled between the sole and the upper topline edge, wherein one or more of the striking face, the sole, and the back portion define at least part of an outer surface of the body;

a channel extending into the body and having an opening in the outer surface of the body; and a weighted insert shaped and sized to be at least partially inserted into the channel and comprising a heavy end and a light end, wherein the channel is oriented such that, when the weighted insert is at least partially inserted into the channel, a longitudinal axis of the weighted insert is substantially parallel to a striking face plane that is tangential to an outermost surface of the striking face, wherein a longitudinal axis of the channel at a first point is the same as the longitudinal axis of the channel at a second point separated from the first point, wherein a shortest distance between the lower leading edge and a heel end of the channel is different from a shortest distance between the lower leading edge and a toe end of the channel, wherein the iron-type golf club head further comprises a cap configured to secure the weighted insert inside the channel and configured to be positionable in at least a closed position whereby the cap secures the weighted insert inside the channel, and in an opened position whereby the weighted insert is at least partially insertable into, and removable from, the channel, and wherein the weighted insert is shaped and sized so that the cap compresses the weighted insert along the longitudinal axis of the weighted insert when the cap is in the closed position.

2. The iron-type golf club head of claim 1, wherein the channel extends at least partially between a toe and a heel of the body and is contained entirely within a wedge-shaped portion of the body protruding from the striking face and defined at least in part by the sole.

3. The iron-type golf club head of claim 1, wherein the opening of the channel is at a toe of the body, and the channel extends into the body towards a heel of the body.

4. The iron-type golf club head of claim 1, wherein the cap comprises a threaded cap configured to be at least partially screwed into the channel when the cap is in the closed position.

5. The iron-type golf club head of claim 1, wherein the cap is pivotally coupled to the body at a fastener and is configured to be pivotable about the fastener between the open position and the closed position when the fastener is in a loosened position.

6. An iron-type golf club head, comprising:

a body having an outer surface and comprising a striking face having a lower leading edge and an upper topline edge;

a channel extending into the body and having an opening in the outer surface of the body;

a weighted insert shaped and sized to be at least partially inserted into the channel and comprising a heavy end and a light end, wherein the channel is oriented such that, when the weighted insert is at least partially inserted into the channel, a longitudinal axis of the weighted insert is substantially parallel to a striking face plane that is tangential to an outermost surface of the striking face; and a threaded cap configured to be at least partially screwed into the channel to secure the weighted insert inside the channel, wherein the threaded cap comprises:

a first component comprising a head and a threaded portion extending from the head and configured to be screwed at least partially into the channel to secure the weighted insert inside the channel, and a second component coupled to the first component and having a hole exposing at least part of the head.

7. The iron-type golf club head of claim 6, wherein the head of the first component is rotatably coupled to the second component by a c-clip.

8. The iron-type golf club head of claim 6, wherein the opening of the channel is in an indent in the outer surface of the body, wherein the second component is shaped and sized such that, when the threaded cap is at least partially screwed into the channel, an exterior surface of the second component is level with a portion of the outer surface of the body adjacent to the indent, and wherein the exterior surface of the second component is at least double in surface area in comparison to a cross-sectional area of the hole.

9. The iron-type golf club head of claim 6, wherein a breadth of the hole in the second component is equal to or less than a breadth of a tool indent in the head.

10. The iron-type golf club head of claim 6, wherein the second component is different in density than the body of the iron-type golf club head.

11. An iron-type golf club head, comprising:

a body having an outer surface and comprising a striking face;

a channel extending into the body and having an opening in the outer surface of the body;

a weighted insert shaped and sized to be at least partially inserted into the channel and comprising a heavy end and a light end, wherein the channel is oriented such that, when the weighted insert is at least partially inserted into the channel, a longitudinal axis of the weighted insert is substantially parallel to a striking face plane that is tangential to an outermost surface of the striking face; and a cap pivotally attached to the body and configured to be in a closed position whereby the cap secures the weighted insert inside the channel and an opened position whereby the weighted insert is at least partially insertable into, and removable from, the channel.

12. The iron-type golf club head of claim 11, wherein the opening of the channel is in an indent in the outer surface of the body, wherein the cap has an interior surface and an exterior surface, and wherein the cap is shaped and sized such that the exterior surface is level with a portion of the outer surface of the body adjacent to the indent when the cap is in the closed position.

13. The iron-type golf club head of claim 11, wherein the cap has an interior surface and an exterior surface, and the interior surface compresses the weighted insert along the longitudinal axis of the weighted insert when the cap is in the closed position.

14. The iron-type golf club head of claim 11, wherein the cap includes a main body configured to secure and retain the weighted insert inside the channel when the cap is in the closed position, and a pivot arm extending from the main body onto a back portion of the body positioned rearward to the striking face, and wherein the cap is configured to pivot about a fastener extending through an opening in the pivot arm.

15. The iron-type golf club head of claim 11, wherein the cap is pivotally attached to the body by a fastener configured to be in at least a tightened position whereby the cap is not moveable between the closed position and the opened position, and a loosened position whereby the cap is moveable between the closed position and the opened position.

16. The iron-type golf club head of claim 15, wherein the fastener is configured to be tightened into the body to keep the cap from pivoting in order to indirectly secure the weighted insert inside the channel by the cap.

* * * * *